United States Patent [19]

Zemlicka

[11] Patent Number: 4,498,876

[45] Date of Patent: Feb. 12, 1985

[54] WATER SHUTTER

[75] Inventor: Alvin R. Zemlicka, Elkhart Lake, Wis.

[73] Assignee: Brunswick Corporation, Skokie, Ill.

[21] Appl. No.: 453,450

[22] Filed: Dec. 27, 1982

[51] Int. Cl.[3] ..... F01N 3/00

[52] U.S. Cl. ..... 440/89; 137/527.8; 251/338

[58] Field of Search ..... 440/88, 89; 180/296; 60/324, 292, 280, 310, 311, 317; 137/527-527.8; 251/358, 338, 305-308; 181/226, 227, 228; 239/265.43

[56] References Cited

U.S. PATENT DOCUMENTS

| | | | |
|---|---|---|---|
| 3,029,063 | 4/1962 | Moen | 251/358 |
| 3,152,608 | 10/1964 | Morrison et al. | 251/358 |
| 3,302,688 | 2/1967 | Thrush | 137/527.8 |
| 3,456,682 | 7/1969 | Blackford | 251/358 |
| 3,465,967 | 9/1969 | Card | 239/265.43 |
| 3,750,698 | 8/1973 | Walchle et al. | 251/305 |
| 3,834,341 | 9/1974 | Sexton et al. | 440/89 |
| 3,946,697 | 3/1976 | Hackbarth et al. | 440/89 |
| 4,178,873 | 12/1979 | Blankstahl | 440/89 |
| 4,191,205 | 3/1980 | Nash | 137/527.8 |
| 4,274,357 | 6/1981 | Dawson | 440/89 |
| 4,315,558 | 2/1982 | Katayama | 181/227 |

OTHER PUBLICATIONS

Boston Belting Co. Publication, Aug. 25, 1914.

*Primary Examiner*—Trygve M. Blix
*Assistant Examiner*—Edwin L. Swinehart
*Attorney, Agent, or Firm*—O. T. Sessions

[57] ABSTRACT

A valve (22) is provided in the exhaust system of a marine engine (11) which discharges its exhaust underwater. The valve (22) includes a valve member (23) formed of a stainless steel plate (24) and of silicon rubber (29). Holes (28) are provided in the plate (24) to form a mechanical bond with the silicon rubber molded to the plate (24).

3 Claims, 4 Drawing Figures

WATER SHUTTER

TECHNICAL FIELD

This invention relates to an exhaust system for a marine engine and particularly to such a system having a valve to prevent water from entering the engine through the exhaust passageway.

BACKGROUND ART

Prior marine engines have used water shutter valves in their exhaust passageways to prevent water from entering the engine through the exhaust passageway. Such valves are shown in U.S. Pat. Nos. 4,178,873 and 3,759,041, both assigned to the assignee of the present application. In addition, it is known to form such shutter valve members from a high temperature resistant plastic, such as Zytel, available from the Dupont Corportion. The prior shutter valves have proven generally satisfactory for use in engines having engine cooling water injected into the exhaust to cool the exhaust before reaching the shutter valve. A problem can arise, however, if the engine is operated even briefly without cooling water flow, since the engine exhaust temperatures can then reach temperatures high enough to damage the valve member.

DISCLOSURE OF INVENTION

A stern drive for propelling a boat includes an inboard engine coupled to power an outboard drive unit. An exhaust passageway is coupled to receive the engine's exhaust and discharge the exhaust below the surface of the water. A valve is mounted in the exhaust passageway to prevent the flow of water to the engine and allow the passage of exhaust from the engine. The valve includes a pivot shaft extending across the exhaust passageway and a valve member pivotally mounted on the shaft. The valve member has a generally planar metal plate member with a lug on each side of the plate member, with the lugs having holes for pivotal attachment to the shaft. An elastomer is mechanically and chemically bonded to the plate member on both sides of the plate member, the elastomer forming a flexible lip around the periphery of the plate member to seal against the walls of the exhaust passageway when the valve member is positioned to close the exhaust passageway. The elastomer thus provides an improved seal when the valve is closed and quiet operation.

The elastomer can be formed around the lugs to provide a bearing surface for carrying the valve member on the shaft. Preferably the lugs include flanges around the periphery of the holes to provide support for the elastomer to increase the effective bearing surface.

The mechanical bond between the elastomer and the metal plate member can conveniently be provided by forming holes through the plate member around its periphery. The elastomer formed through the holes mechanically holds the elastomer in place. Preferably, the elastomer is a silicon rubber while the metal plate member is a stainless steel to provide the necessary heat and corrosion resistance.

BEST MODE FOR CARRYING OUT THE INVENTION

Figure 1:
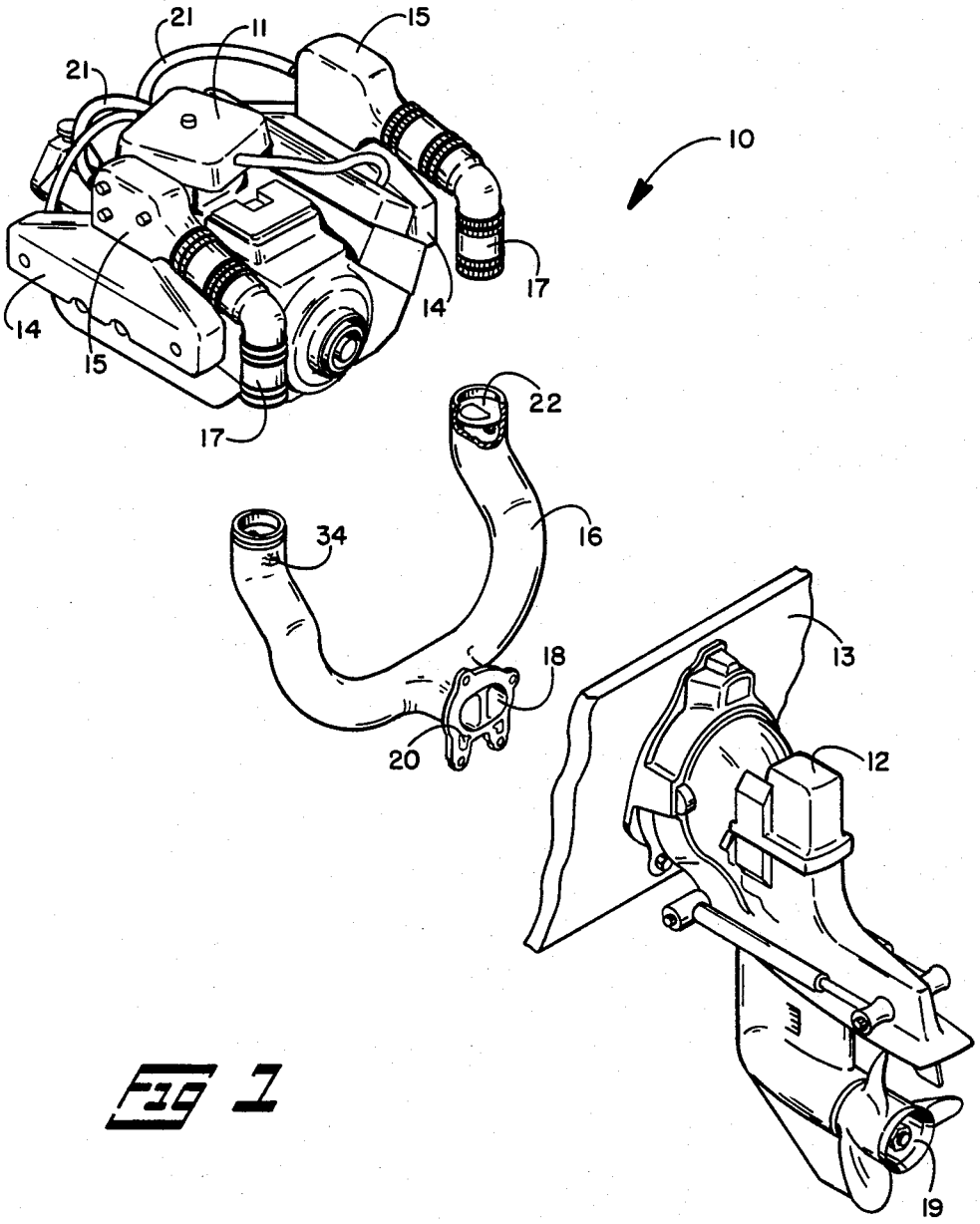
FIG. 1 is a perspective exploded view of a stern drive incorporating the present invention.
Figure 2:
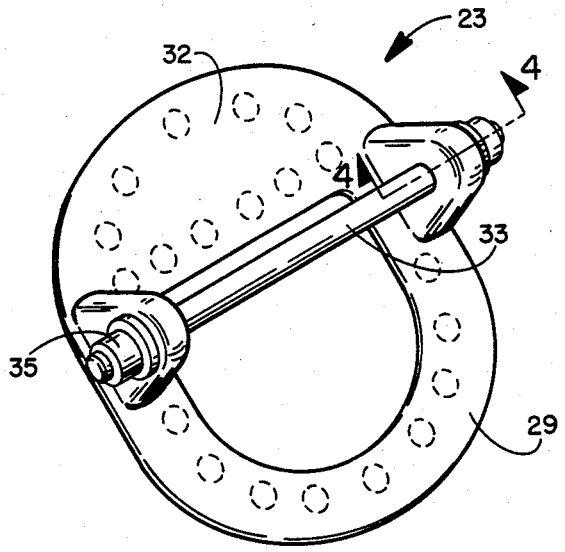
FIG. 2 is an enlarged view, partially in section of the valve member of the invention.
Figure 3:
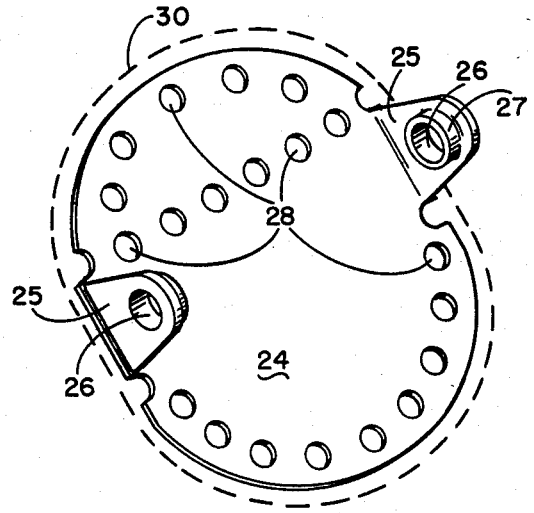
FIG. 3 is a view of the metal component of the valve member shown in FIG. 2.
Figure 4:
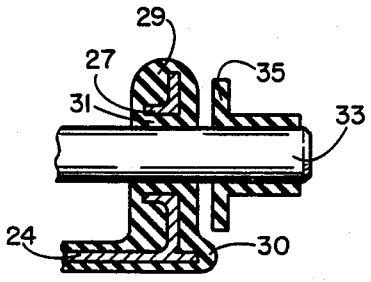
FIG. 4 is a partial sectional view showing details of the valve member.

Referring to the drawings, the stern drive 10 illustrated in FIG. 1 includes a water cooled marine engine 11 carried in a boat. An outboard drive unit 12 is mounted on the transom 13 of the boat and coupled to be driven by the engine 11 in a conventional manner.

An engine exhaust system includes two exhaust manifolds 14 mounted on the engine 11, with an exhaust manifold elbow 15 mounted on each manifold 14. A generally U-shaped exhaust pipe 16 has its upper ends connected by flexible exhaust bellows 17 to the manifold elbows 15. At its lower end the exhaust pipe 16 has an outlet coupled to the drive unit 12 to pass the exhaust gases through internal passages (not illustrated) to be discharged under the water through the propeller hub 19. At its lower end the exhaust pipe 16 also includes a water ejector 20 constructed in accord with the teachings of U.S. Pat. No. 3,759,041, entitled "Exhaust Water Separator for Marine Engines". Engine cooling water flows through hoses 21 from the engine block into cooling passages (not illustrated) in the exhaust manifold 14. The cooling water is then mixed with the engine exhaust at or near the outlets of the manifold elbows 15 in general accord with the description in U.S. Pat. No. 3,541,786 entitled "Inboard Marine Engine Cooling System". The exhaust is normally sufficiently cooled by the water to prevent damage to the components of the exhaust system.

A water shutter valve 22 is provided in the upper portion of each leg of the U-shaped exhaust pipe 16 to prevent reverse flow of water through the exhaust system to the engine 11, though only one is illustrated. The water shutter valve 22 includes a valve member 23 having a plate member 24 stamped from a stainless steel plate. A pair of lugs 25 are formed, one on each side of the plate 24, with mounting holes 26 stamped in each lug 25 and including flanges 27 around the holes 26. A series of holes 28 are formed around the periphery of the plate 24 and across the plate above the lugs 25.

The holes 28 in the plate 24 provide a mechanical bond for preventing separation of an elastomer 29, preferably as silicon rubber, molded to the plate 24 around its periphery. The silicon rubber 29 forms a lip 30 around the periphery of the plate 24 to aid in sealing when the valve is closed. The silicon rubber is formed on the plate 24 by applying a bonding agent to the plate, inserting the plate in a mold and injecting the silicon rubber into the mold. At the same time the silicon rubber forms a bushing 31 around the lugs 25, supported by the flanges 27 around the lug holes 26. The silicon rubber is also formed across the top of the plate to serve as a counter balance 32 to balance the valve member 23 at the desired orientation.

The aluminum exhaust pipe 16 has flats formed on each side of the valve member 23 to provide sealing along the sides of the valve member 23. A stainless steel pin 33 extends across the exhaust pipe 16, supported by holes 34 in the exhaust pipe walls, through the holes 26 in the valve member lugs 25 to pivotally support the valve member 23. A pair of silicon rubber shoulder bushings 35 are provided in the holes 34 in the exhaust pipe 16 to seal around the pin 33 and isolate the stainless steel pin 33 from the aluminum pipe 16. When installed, the pin holes 34 are also covered on the outside by the flexible exhaust bellows 17, thus preventing exhaust leakage.

The exhaust valve member 23 is shaped to close the exhaust passage at an angle of approximately 60 degrees from the vertical, but is balanced to normally hang at an angle of approximately 38 degrees from the vertical. Because the valve 22 is normally not closed in the absence of flow, the back pressure on to the engine is substantially reduced, particularly when the engine is started and run at low speeds, thus providing increased fuel economy.

While not normally closed, the valve 22 will rapidly close if water rises up through the exhaust pipe 16 and reaches the valve 22. This is particularly important if the engine 11 should rotate backwards, a condition that can arise when a hot engine is turned off and continues to fire.

A water shutter valve, constructed as described above, provided markedly improved performance in the reverse running situation when compared with a valve member similarly constructed of DuPont Zytel plastic. Further, the valve of the invention withstood the increased exhaust temperatures occurring when cooling water was not mixed with the exhaust with no noticeable damage to the valve member.

I claim:

1. A stern drive for propulsion of a boat comprising:

(A) an inboard engine;

(B) an outboard drive unit coupled to said engine;

(C) an exhaust passageway coupled to receive exhaust from said engine, said exhaust passageway having a discharge end for discharging exhaust below the surface of the water on which said boat is operated;

and (D) a valve mounted in said exhaust passageway for preventing the flow of water to said engine and allowing the passage of exhaust from said engine, said valve including:

(1) a pivot shaft extending across said passageway; and (2) a valve member pivotally mounted on said shaft, said valve member having;

(a) a generally planar metal plate member with a lug on each side extending generally perpendicular to the plane of said plate member, said lugs having holes therethrough for pivotal attachment to said shaft; and (b) an elastomer mechanically and chemically bonded to said metal plate member on both sides of said plate member, said elastomer forming a flexible lip around the periphery of said plate member to seal against the walls of said exhaust passageway when said valve member is positioned to close said exhaust passageway, said elastomer formed around said lugs to act as a bearing on said shaft.

2. The stern drive defined in claim 1 wherein said holes in said lugs include flanges around their periphery to provide support for said elastomer acting as a bearing.

3. A stern drive for propulsion of a boat comprising:

(A) an inboard engine;

(B) an outboard drive unit coupled to said engine;

(C) an exhaust passageway coupled to receive exhaust from said engine, said exhaust passageway having a discharge end for discharging exhaust below the surface of the water on which said boat is operated; and (D) a valve mounted in said exhaust passageway for preventing the flow of water to said engine and allowing the passage of exhaust from said engine, said valve including:

(1) a pivot shaft extending across said passageway; and (2) a valve member pivotally mounted on said shaft, said valve member having:

(a) a generally planar stainless steel plate member with a lug on each side extending generally perpendicular to the plane of said plate member, said lugs having holes therethrough for pivotal attachment to said shaft, said plate member including a plurality of holes extending through said plate member around its periphery; and (b) an elastomer comprising silicon rubber mechanically and chemically bonded to said metal plate member on both sides of said plate member, said elastomer forming a flexible lip around the periphery of said plate member to seal against the walls of said exhaust passageway when said valve member is positioned to close said exhaust passageway, said plurality of holes around the periphery of said plate member providing a mechanical bond between said elastomer and said plate member, said elastomer covering only a portion of said metal plate member including a band around the periphery of said plate member and a further portion on one side of said pivot shaft to provide a counter balance for said valve member.

* * * * *